US006321825B1

(12) United States Patent
Damm et al.

(10) Patent No.: US 6,321,825 B1
(45) Date of Patent: Nov. 27, 2001

(54) PROCESS AND APPARATUS FOR THE UPHILL LOW PRESSURE CASTING OF METAL, PARTICULARLY LIGHT METAL

(75) Inventors: Norbert Damm, Schaffhausen; Herbert Zulauf, Feuerthalen, both of (CH)

(73) Assignee: Georg Fischer DISA AG, Schaffhausen (CH)

( * ) Notice: Subject to any disclaimer, the term of this patent is extended or adjusted under 35 U.S.C. 154(b) by 0 days.

(21) Appl. No.: 09/301,604

(22) Filed: Apr. 29, 1999

(30) Foreign Application Priority Data

May 13, 1998 (DE) ..... 198 21 419

(51) Int. Cl.[7] ..... B22D 18/00; B22D 37/00

(52) U.S. Cl. ..... 164/119; 164/120; 164/136

(58) Field of Search ..... 164/119, 120, 164/306, 309, 319, 321, 136

(56) References Cited

FOREIGN PATENT DOCUMENTS

| | | | | |
|---|---|---|---|---|
| 1150182 | * | 6/1963 | (DE) | 164/309 |
| 55-10381 | * | 1/1980 | (JP) | 164/306 |
| 0099104 | * | 1/1984 | (EP) | 164/119 |
| 3344537 | | 6/1985 | (DE) . | |
| 3924775 | | 3/1990 | (DE) . | |
| 4332760 | | 3/1995 | (DE) . | |
| 29708575 | * | 7/1997 | (DE) . | |
| 2-155557 | * | 6/1990 | (JP) | 164/120 |
| 2-192869 | * | 7/1990 | (JP) | 164/120 |
| 61-56763 | * | 3/1986 | (JP) | 164/306 |
| WO93/11892 | | 6/1993 | (WO) . | |
| 9520449 | | 8/1995 | (WO) . | |
| WO95/32826 | | 12/1995 | (WO) . | |
| 9737797 | | 10/1997 | (WO) . | |

OTHER PUBLICATIONS

Patent Abstracts of Japan, vol. 007, No. 237 (M–250), Oct. 21, 1983 and JP 58–125358 Published Jul. 26, 1983.

Patent Abstracts of Japan, vol. 016, No. 057 (M–1210), Feb. 13, 1992 and JP 3–254353 Published Nov. 13, 1991.

* cited by examiner

*Primary Examiner*—Nam Nguyen
*Assistant Examiner*—I.-H. Lin
(74) *Attorney, Agent, or Firm*—Antonelli, Terry, Stout & Kraus, LLP

(57) ABSTRACT

In the case of uphill low pressure casting of metals, particularly light metal, a casting mold is connected by its gate, via a riser to a melting container and the melt contained therein is displaced under pressure through the riser into the mold. For increasing the casting capacity while maintaining a high quality of the casting, most of the melt volume necessary for filling the mold is displaced into the latter at the maximum casting speed, then the melting column in the riser is sheared and a residual volume remaining between the shearing point and the gate is displaced into the mold with a negative speed gradient. An apparatus for performing the above process is includes a tubular portion provided between the riser and the gate, the tubular portion forming a residual volume, an opening being formed between the riser and the tubular portion. A controlled displacer is movable at controlled speed between a casting position freeing the opening between the riser and the tubular portion, via an intermediate position closing the opening, into an end position closing the gate

7 Claims, 5 Drawing Sheets

PROCESS AND APPARATUS FOR THE UPHILL LOW PRESSURE CASTING OF METAL, PARTICULARLY LIGHT METAL

BACKGROUND OF THE INVENTION

The invention relates to a process for the uphill low pressure casting of metal, particularly light metal, in that a casting mould provided with at least one feeder has its gate connected by means of a riser to a melting container and the melt contained therein is displaced under pressure through the riser into the casting mould.

In the past light metals, particularly aluminium, have acquired increasing significance as constructional materials. This also applies with respect to motor vehicle construction, particularly engine building. Thus, of late, engine blocks have been made from aluminium. Due to the mass production in the car industry it is also necessary to make available high efficiency casting processes and installations. In addition, a high quality standard must be maintained, particularly for heavy-duty components. As aluminium, particularly in the molten state, spontaneously oxidizes with atmospheric oxygen, in the presence of oxygen, an oxide skin very rapidly forms on open melt surfaces.

To avoid this to the greatest possible extent, e.g. both for mould casting and die casting, the low pressure casting process has proved satisfactory, particularly in implementing uphill casting, because the melt is not subject to turbulence and instead the mould or die is filled with a killed melt front. As a result it is possible to largely avoid oxide inclusions in the casting.

However, these measures typical for low pressure casting lead to the disadvantage that efficiency is relatively low. This can inter alia be attributed to the fact that after each casting or teeming operation, the pressure in the melting vessel must be reduced, which is in turn associated with the lowering of the melting column in the riser. Atmospheric oxygen penetrates the riser from the environment. Thus, an oxide skin is formed on the small surface of the melting column and during the further rising of said column during the next melting cycle is applied to the riser wall and is constantly re-formed on the melt front, so that the riser gradually becomes incrusted. Efficiency is reduced by the need to regularly replace the riser at relatively short time intervals. It is also an important disadvantage that the oxide skin formed on the surface of the melting column is introduced into the mould or die and subsequently reappears in the cast structure.

In low pressure casting installations it is known (WO 95/20449) to provide a closure in the area of the transition from the riser to the mould. Its main function is to prevent turbulence in the melting vessel, particularly in the gas cushion located above the melt level. The closure comprises a melting plate having a lower melting point than the aluminium melt and which is to be inserted at the transition between the riser and the gate. As the melt rises this closure plate is liquefied. These liquid foreign components are introduced into the mould and lead to highly undesired inclusions in the casting. It is necessary to replace the closure after each teeming process, so that efficiency is correspondingly low.

In another known process (WO 97/37797) between the riser opening and the mould is located a refeeder in the form of a container, through which the melt from the riser is displaced into the mould. The container has a bottom-side slide closure, which closes the mould after filling. Following teeming the mould together with the refeeder is uncoupled from the riser and the casting shrinkage is compensated by supplying melt from the refeeder into the mould. This also fails to make it possible to increase efficiency compared with conventional low pressure casting installations, particularly as the refeeder must be emptied for the next casting cycle and returned to the casting station.

According to another of applicants' (DE 198 07 623) at the end of each casting cycle the melting column extending from the riser into the mould gate is sheared close to the riser opening and accompanied by simultaneous closure thereof. As a result of the shearing of the melting column close to the riser opening, no free volume and therefore no free surface, where an oxide skin could form, is formed above the melting column. Thus, no oxide coating can become attached to the riser and cannot incrust the latter. The closure also ensures that no oxide skin is drawn into the mould during the following casting cycle. It is also advantageous if, following the shearing of the melting column, in the melting vessel is maintained an overpressure at least maintaining the melting column against the closure. This makes it possible to increase the efficiency of the casting installation.

The production of light metal castings in large numbers and high casting tonnages requires much higher specific casting capacities, which have hitherto been approximately 1 kg/s. To improve the economics of the installations, ever shorter cycle times are sought. Thus, there is also a demand for shorter casting times per cycle or for the same partial weights the requirement for a higher melt throughput during mould filling. The higher specific casting capacities of well above 1 kg/sec, e.g. 3 to 10 kg/sec in the case of uphill casting lead to high, local casting speeds. However, they are limited by the lack of erosion resistance of the moulding materials, through the geometry of the castings and ingates in narrow cross-sections, but mostly by the undesired, dynamic filling impact at the end of casting. For a given part geometry, dynamic filling impact at the end of casting is mainly dependent on the venting behaviour of the mould (gas permeability with sand moulds, vent holes, etc.) and in any case on the casting speed at the end of casting shortly before the complete filling of the mould.

In the sand casting process, particularly green-mould casting, surface faults on the castings are known, which are mainly caused by filling impact at the end of casting. In the final phase of mould filling the kinetic energy of the melt at the elevated mould surfaces is abruptly transformed into impact energy. This dynamic impact drives the melt into the pores of the sand surface and produces there undesired rough surfaces on the casting contour. As a result inhomogeneously compressed mould parts are affected to a varying extent. In many cases castings damaged in this way must be remachined with considerable dressing expenditure or must be abandoned as scrap.

Another effect of the filling impact is increased burr formation in the parting areas of the mould halves and the cores. Burr formation leads to expensive dressing activities, which as a function of the type of part can represent over 30% of the manufacturing costs of the casting. Therefore, great economic significance is attached to casting with little or no burr formation.

A third fault or defect type is blowhole formation due to air and gas inclusions, which arise during casting, but mainly in the phase just before the end of casting. As a preventive measure the casting gases are removed by means of air outlet ducts, vent holes, the use of open feeders or the use of moulding materials with a high gas permeability. Faults of the aforementioned type already occur with the presently conventional, low casting capacities of 1 to 2 kg/sec for aluminium alloys. If the casting capacity is significantly increased, it is to be expected that blowhole formation will significantly increase. Various uphill casting methods are known. Thus, e.g. a gas pressure cushion is used in the melting container or furnace and this fills the melt via the riser connected to the mould. In place of the gas pressure in the melting container use is also made of electromagnetic pumps at the foot of the riser and which take over the filling task. In both cases use is made of a so-called active filling, i.e. the filling process is controlled and regulated in the form of a speed-time profile or volume-time profile as a function of the level change in the melting container (DE 33 17 474=EP 0 128 280, EP 0 215 153). In principle, these methods make it possible to counteract the undesired, dynamic filling impact towards the end of mould filling. The increase in the casting tonnage and therefore the rise in the casting capacity per casting cycle make new demands on the known casting processes. Higher melt throughputs necessarily lead to larger melt or furnace charges and furnace volumes, because due to the high demands made on the melt quality the refilling cycles must not be too short. Large furnace volumes make the regulatability of the filling process more difficult, specifically in gas pressure filling processes. The greater mass inertia of the melt then leads in the case of rapid furnace pressure changes to oscillations of the metal mass in the furnace. This makes it more difficult or even impossible to control the melt filling profile. Particularly at the end of casting the previously accelerated melt mass cannot be slowed down sufficiently quickly and in oscillation-free manner.

SUMMARY OF THE INVENTION

An object of the invention is to permit a higher casting speed and therefore higher cycle times in the case of a high casting quality in the case of the uphill casting of light metal.

According to the invention this problem is solved in that most of the melt volume necessary for filling the casting mould is displaced into the latter at the maximum casting speed, then the melting column in the riser is sheared and a residual volume remaining between the shearing point and the gate is displaced into the mould with a negative speed gradient.

In the process according to the invention the filling operation is subdivided into two portions, the first portion following the conventional uphill casting process, in that with a predetermined, free cross-section of the riser the melting column is accelerated solely by the forward thrust at the melting container or furnace to the maximum casting speed and the latter is maintained until just before the end of casting. The melting column is then sheared close to the gate, so that the maximum casting speed is still maintained for a short time until the melting column has been completely sheared. The residual volume remaining between the shearing point and the gate is then displaced into the mould with constantly decreasing speed, so that the melt front more slowly rises within the mould and firstly the residual air still present in the mould can escape in controlled manner and secondly a dynamic filling impact on the mould surfaces at the top is avoided. This also avoids the building up of an excessive hydrostatic pressure in the melt volume in the mould.

As a result of the process according to the invention, particularly in the case of sand moulds, the penetration of the melt into the mould surface and the erosion of the mould by impulse forces are avoided, so that despite a possible increase in the casting capacity completely satisfactory cast article surfaces are obtained. Through avoiding a build up of an excessive isostatic pressure, it is also ensured that the melt does not penetrate the mould parting areas and does not lead to burr formation. Through the shearing of the residual volume from the melting column, oscillations emanating from the melting container cannot be transferred to the residual volume. Due to its relatively limited mass and the negative speed gradient, the residual volume is displaced in oscillation-free manner into the mould.

Preferably the residual volume is displaced into the mould with a non-constant speed gradient, e.g. initially with the maximum casting speed and then with a shallow, followed by a steep, negative speed gradient.

The process according to the invention in particular offers the possibility of choosing the size of the residual volume as a function of the volume and/or geometry of the casting. The larger the casting volume and the more complex the geometry of the casting in the upper area, the larger the chosen residual volume.

In addition, the speed gradient and/or its time pattern can be selected as a function of the volume and/or geometry of the casting. In the case of a complex geometry, particularly in the upper area of the mould, a faster reduction of the speed gradient is possible than with large-volume and not very complex moulds.

The residual volume should represent approximately 10% of the volume of the casting and is preferably 3 to 7 vol. % thereof.

For performing the process, the invention is based on an apparatus having a conveyor belt for the cyclic movement of the casting moulds with at least one feeder and a gate, a casting station on the conveyor belt on which the moulds can be successively positioned, a melting container, particularly melting furnace, positionable at the casting station, a riser immersed in the melt, to which the mould gate can be connected at the casting station and a pressure generator for displacing the melt from the melting container, via the riser and the gate into the mould.

According to the invention, such an apparatus is characterized in that at the transition between the riser and the gate is located a tubular portion forming the residual volume and in which a controlled displacer is movable between a casting position freeing the riser opening in this portion, via an intermediate position closing the opening into a position closing the gate.

The melting column displaced into the riser passes at the maximum casting speed, via the tubular portion and the gate into the mould. Towards the end of the casting cycle the displacer is controlled and reduces the free cross-section of the opening in a predetermined time, at the end of which the melting column is completely sheared, so that the furnace-side propelling forces acting thereon can no longer act on the residual volume enclosed in the tubular portion. This residual volume is then displaced into the mould by means of the displacer with the predetermined, negative speed gradient, until the displacer reaches its end position in which it closes the gate.

Preferably, the tubular portion is aligned with the gate, so that the residual volume is displaced in translatory and therefore readily controllable manner into the mould without any deflection. This can advantageously take place with a vertical gate at the bottom of the mould or with a horizontal, lateral gate.

The displacer speed is preferably controllable as a function of the casting geometry and/or volume and optionally is preprogrammable.

At least the tubular portion can be replaced by a portion having a different volume or can be extended by a further portion, in order to bring about an optimum adaptation of the residual volume to the casting geometry or volume.

In a preferred development the tubular portion and displacer are formed by a cylinder-piston unit and the riser issues laterally into the cylinder close to the piston end position remote from the gate.

Optionally, the complete cylinder-piston unit can be replaced by another such unit with a different cylinder volume.

BRIEF DESCRIPTION OF THE DRAWINGS

The invention is described in greater detail hereinafter relative to embodiments and the attached drawings, wherein show.

DESCRIPTION OF THE PREFERRED EMBODIMENTS

Figure 1:
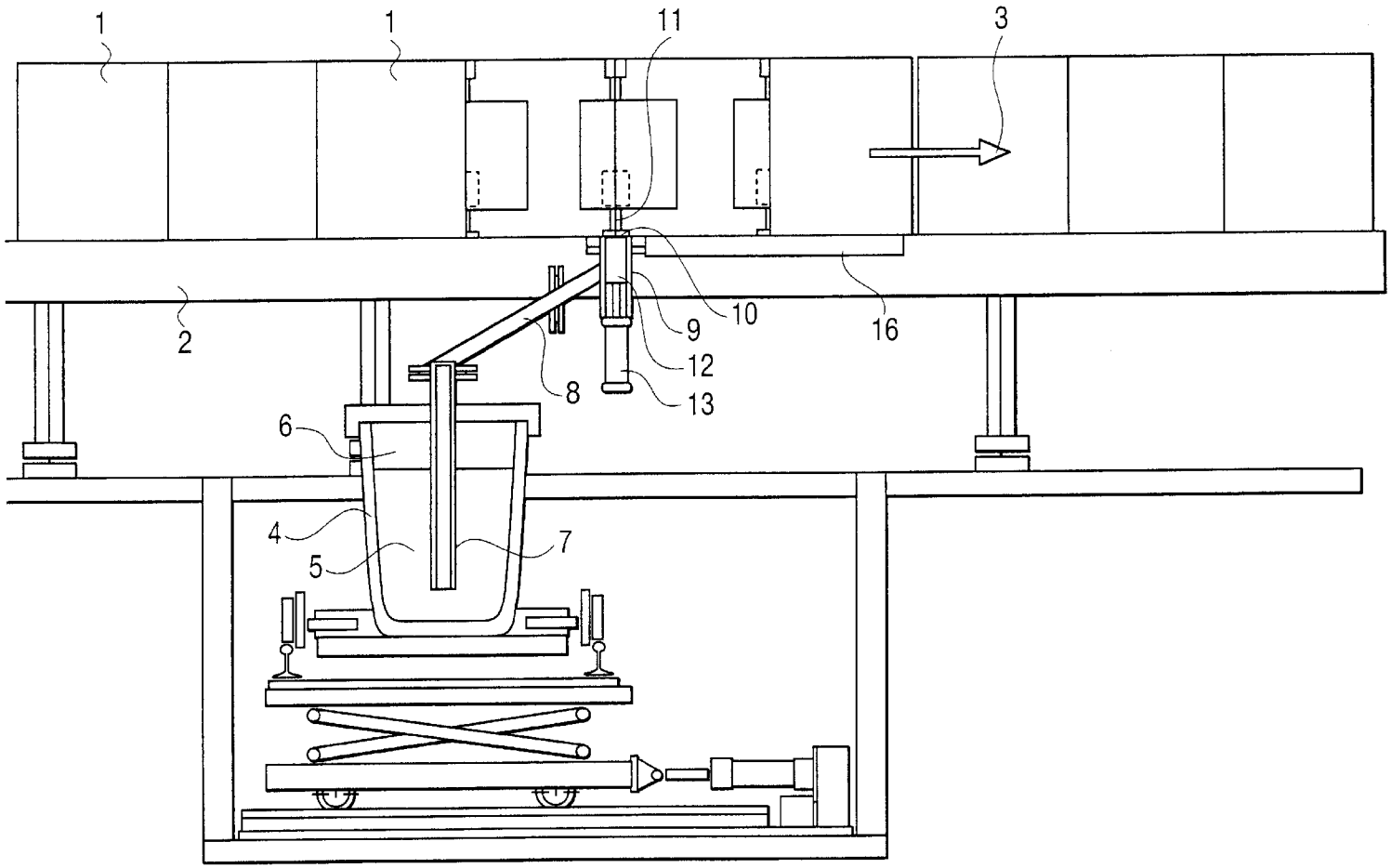
FIG. 1 A diagrammatic view of a low pressure casting installation for boxless sand casting in a first operating position.

The casting installation constructed according to the invention is suitable both for sand mould casting and for die casting. The embodiments shown in the drawings exclusively relate to casting in sand moulds (with or without moulding boxes).

Figure 2:
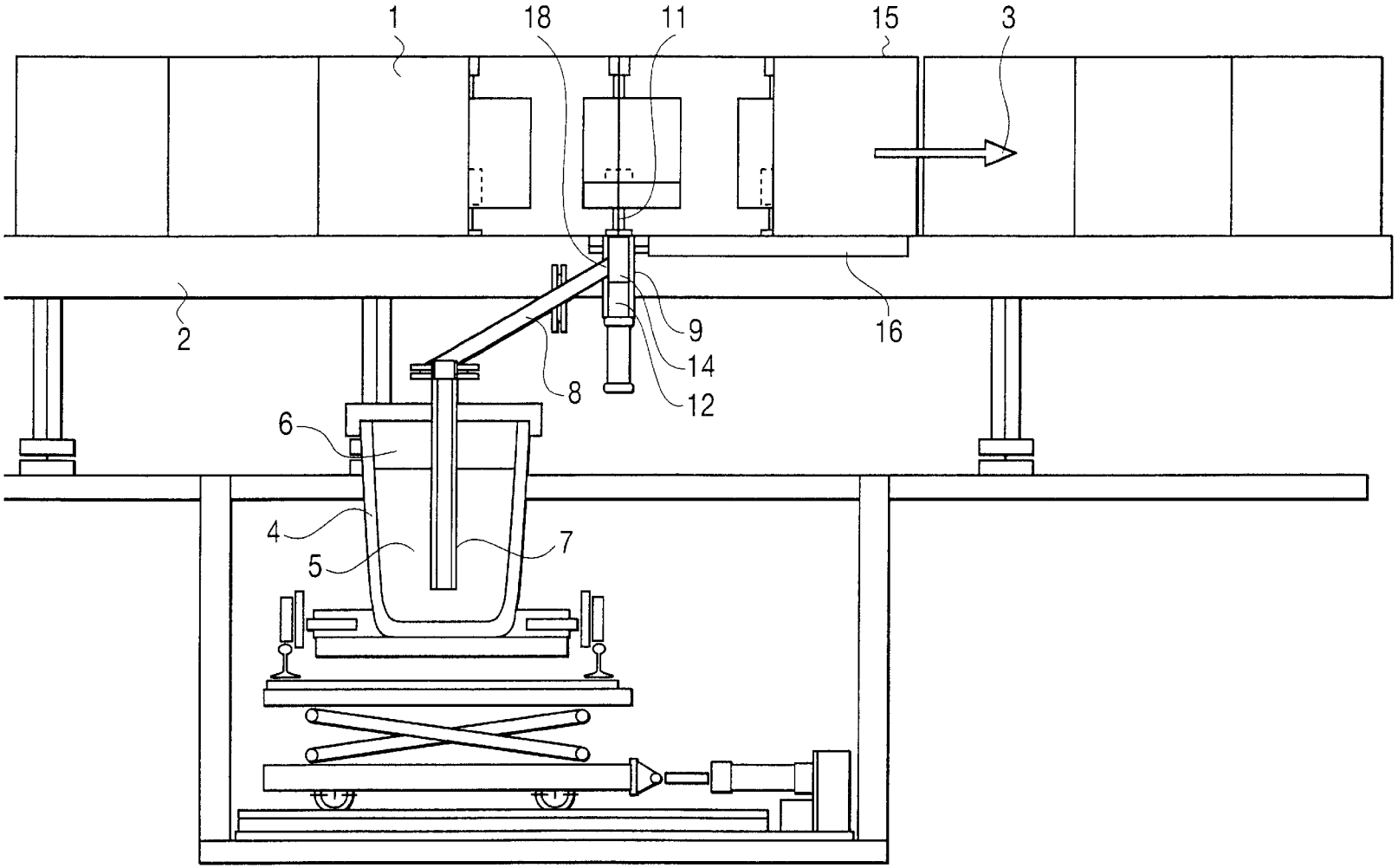
FIG. 2 The casting installation according to FIG. 1 in a further operating position.

In the embodiment according to FIGS. 1 and 2 the casting moulds are successively positioned in the form of boxless mould bodies 1 on a conveyor 2 forming the conveyor belt. The mould bodies 1 are conveyed in the direction of the arrow 3 to a casting station, where a melting vessel 4, optionally in the form of a furnace, is placed in a raisable, lowerable and displaceable manner. The melting vessel 4 contains the light metal melt 5, over whose surface there is a gas cushion 6, which is subject to the action of a controllable pressure generator. A riser 7 is immersed in the melting vessel 4. In the present embodiment said riser extends upwards via a sloping portion 8 and a short, straight, tubular portion 9 and terminates at an opening 10. Above said opening the mould bodies 1 are so timed or cycled by means of the conveyor 2 that one mould body comes into the casting position during each cycle. The apparatus with the short, vertical riser portion 9 is then adjusted in such a way that the riser becomes aligned with the mould body gate 11. The tubular portion 9 contains a displacer in the form of a piston 12 and which is operated by means of a pressure cylinder 13.

From the mould-close end position shown in FIG. 1, in which the gate 11 is closed, the piston 12 is moved into the other end position shown in FIG. 2, in which it completely frees the short, vertical position of the riser 7, so that under the action of the overpressure prevailing in the melting vessel 4 the melt passes into the mould. Before the mould is completely filled, the piston 12 is again moved into the other end position (FIG. 1), in which it displaces into the mould the residual melt volume 14 located in portion 9. The teemed mould bodies leave the casting station in the direction of arrow 3.

An overpressure is maintained in the melting vessel when the piston 12 is in the closed position (FIG. 1), but this can be lower than the casting pressure. This ensures that the sinking of the melting column in the riser 7 does not lead to an underpressure in the upper part, which by means of leaks could lead to a penetration of atmospheric oxygen.

In the embodiment according to FIGS. 1 and 2 directly below the mould bodies and in contact therewith is provided a cooling plate 16 over which pass the mould bodies with the gate 11, so that melt in the latter is rapidly solidified.

Figure 3:
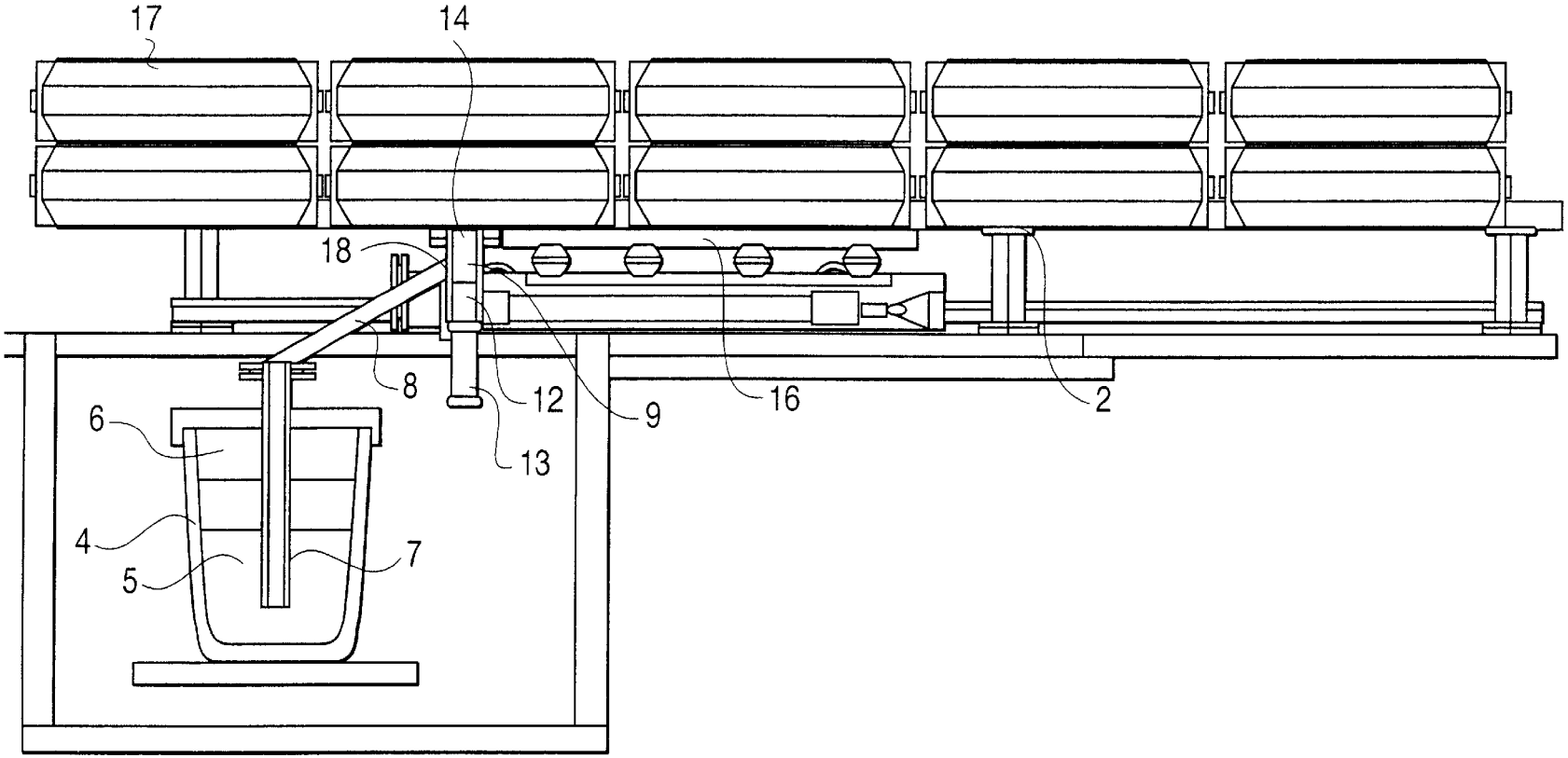
FIG. 3 A diagrammatic view of a low pressure casting installation for box casting in a first operating position.
Figure 4:
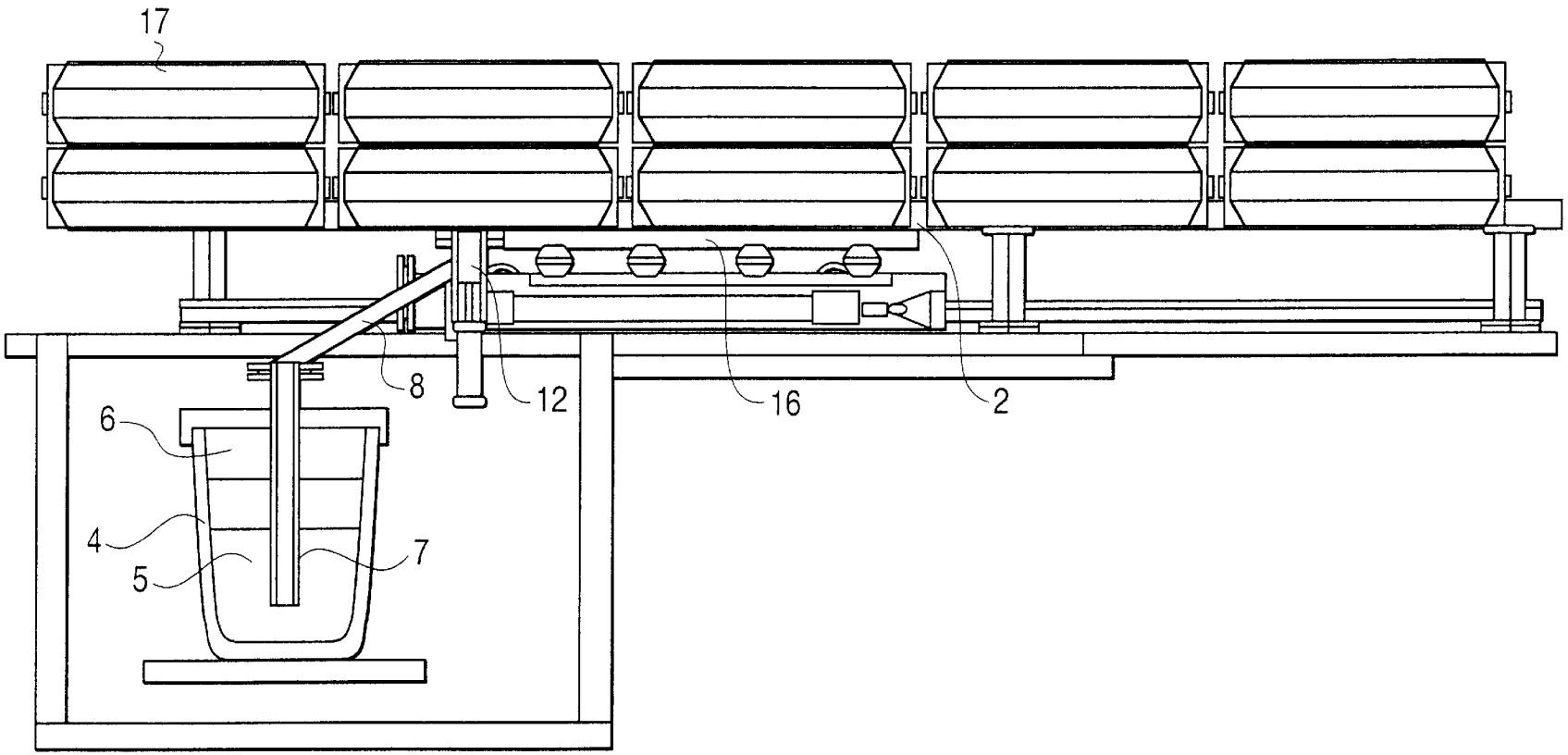
FIG. 4 The casting installation according to FIG. 3 in another operating position.

The embodiment according to FIGS. 3 and 4 essentially only differs from that according to FIG. 1 in that box moulds 17 are teemed.

In the casting process shown in FIGS. 2 and 3 the melting column extends from the melting container 4 into the mould. The melting column is displaced at a maximum casting speed into the mould by means of the inlet pressure in the melting container. Towards the end of the casting cycle the piston 12 is controlled and initially passes over the opening 18 (FIGS. 2 and 3) of the inclined riser portion 8, shears the melting column at a shearing point 33 and at the same time displaces the residual volume 14 in the vertical portion 9 into the mould.

Figure 5:
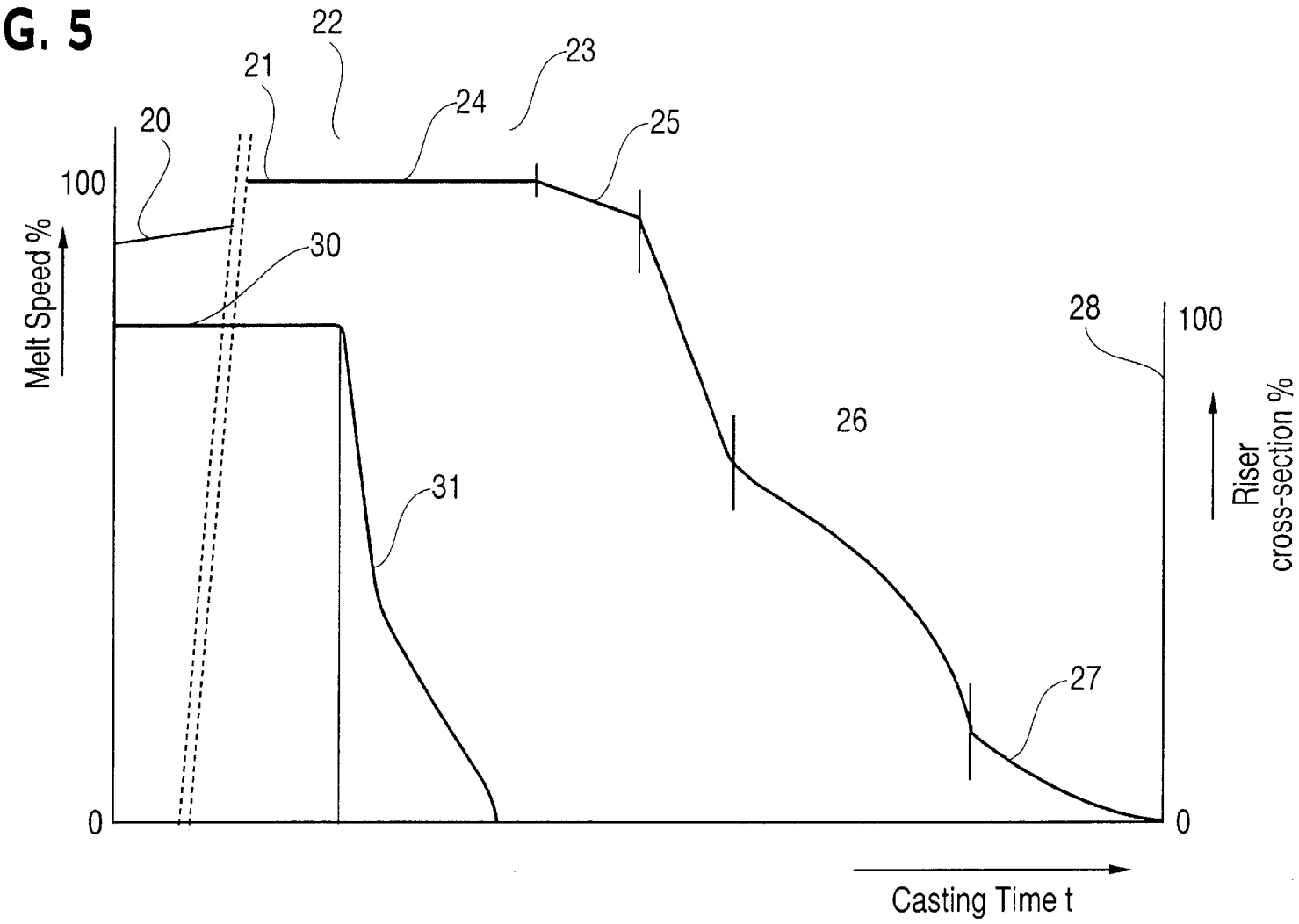
FIG. 5 A time diagram relating to the starting up of the casting process.

FIG. 5 shows the time pattern of the casting speed and the change in the riser cross-section towards the end of the casting process. When a mould has been brought into the casting position the piston 12 is moved downwards, so that the opening 18 is freed and the melt from the melting container 4 is displaced via the riser 7, 8 into the vertical portion 9 and then via the gate 11 into the mould. The speed of the melting column in the curve portion 20 rises in accordance with the inlet pressure in the melting furnace very rapidly to the maximum casting speed 21. The riser cross-section or opening 18 is completely freed, as is indicated by the curve portion 30. Towards the end of the casting process when still up to about 10% of the melt volume is missing in the mould, the piston 12 is controlled. In the diagram of FIG. 5 this occurs at 22. The riser cross-section rapidly decreases through the increasing overtravelling of the opening 18 by the piston 12, as indicated by curve portion 31, until finally the piston 12 has completely sheared the melting column at opening 18, as indicated at 23 in the diagram. On the curve portion 24 the casting speed initially remains at the maximum value and then decreases with negative speed gradient, initially over a short period with a flat or shallow decrease in the curve portion 25 and then rapidly drops away in curve portion 26, whilst finally running out in shallow manner in the curve portion 27 until the gate 11 is closed by the piston 12 at 28. The pattern of the casting speed in curve portions 24, 25, 26 and 27 is only shown in exemplified manner and is also dependent on the casting geometry and is adaptable thereto.

What is claimed is:

1. Process for uphill low pressure casting of light metal, comprising:

connecting a gate of a casting mould provided with at least one feeder via a riser to a melting container containing a melt;

displacing the melt contained in the melting container under pressure through the riser into the casting mould at a maximum casting speed until most of a melt volume necessary for filling the mould is displaced into the mould; and then shearing a melting column in the riser at a shearing point spaced apart from the gate, whereby a residual volume sufficient to complete the filling of the mould is defined in a portion of the riser between the shearing point and the gate and displacing the residual volume remaining between the shearing point and the gate with a negative speed gradient into the mould.

2. Process according to claim 1, characterized in that the residual volume is displaced into the mould with a non-constant speed gradient.

3. Process according to claim 2, characterized in that the residual volume is displaced into the mould initially at the maximum speed, then with a steep negative speed gradient.

4. Process according to claim 1, characterized in that the size of the residual volume is selected as a function of a volume and/or geometry of the casting.

5. Process according to claim 1, characterized in that the speed gradient and/or its time pattern is selected as a function of a volume and/or geometry of the casting.

6. Process according to claim 1, characterized in that up to approximately 10% of a casting volume forms the residual volume.

7. Process according to claim 6, characterized in that 3 to 7 vol. % of the casting form the residual volume.

* * * * *